US007658177B2

(12) United States Patent
Baasch et al.

(10) Patent No.: US 7,658,177 B2
(45) Date of Patent: Feb. 9, 2010

(54) AIR VALVE AND METHOD OF USE

(75) Inventors: Oswald Baasch, Bowling Green, KY (US); Roy E. Tedder, Utica, KY (US); Siamak Attarseyedi, Yardley, PA (US); Jared A. Brandt, Franklin, KY (US); Neal R. Gerber, Park City, KY (US); Nigel C. Janes, Bowling Green, KY (US); Jasper C. Lindsey, Morgantown, KY (US); Jon A. Bigley, Bowling Green, KY (US)

(73) Assignee: Holley Performance Products, Inc., Bowling Green, KY (US)

( * ) Notice: Subject to any disclaimer, the term of this patent is extended or adjusted under 35 U.S.C. 154(b) by 283 days.

(21) Appl. No.: 11/681,551

(22) Filed: Mar. 2, 2007

(65) Prior Publication Data

US 2008/0110436 A1 May 15, 2008

Related U.S. Application Data

(63) Continuation-in-part of application No. 11/559,067, filed on Nov. 13, 2006, now abandoned.

(51) Int. Cl.
*F02D 11/10* (2006.01)

(52) U.S. Cl. ..... 123/399

(58) Field of Classification Search ..... 123/399
See application file for complete search history.

(56) References Cited

U.S. PATENT DOCUMENTS 3,741,179 A 6/1973 Vartanian
3,915,134 A 10/1975 Young et al.
4,171,689 A 10/1979 Eheim
4,329,965 A 5/1982 Ueda et al.
4,364,369 A 12/1982 Nomura et al.
4,690,119 A 9/1987 Makino et al.
4,742,989 A 5/1988 Akagi
5,029,597 A 7/1991 Leon
5,035,228 A 7/1991 Bender
5,333,456 A 8/1994 Bollinger
5,411,452 A 5/1995 Katayama
5,508,926 A 4/1996 Wade
5,606,957 A 3/1997 Feucht (Continued)

OTHER PUBLICATIONS

International Search Report for Corresponding International Patent Application No. PCT/US2007/084449.

(Continued)

*Primary Examiner*—Erick Solis
(74) *Attorney, Agent, or Firm*—Hunton & Williams LLP

(57) ABSTRACT

An air valve and its method of use including an air valve housing; a throttle plate disposed on a throttle shaft; a driven gear attached on the throttle shaft; a brushless direct current motor assembly in connection via a pinion with the driven gear; an integrated electronic valve controller including digital signal processing on a circuit board; and a throttle position sensor on the circuit board, wherein the throttle position sensor includes at least one non-contact type sensor. In a preferred embodiment, the air valve includes an inlet port and an outlet port connected to an engine via an air intake manifold, such that re-circulated exhaust gas is introduced into the air intake manifold.

17 Claims, 2 Drawing Sheets

U.S. PATENT DOCUMENTS

| | | | | |
|---|---|---|---|---|
| 5,785,034 | A | 7/1998 | Moedinger et al. | |
| 5,937,834 | A | 8/1999 | Oto | |
| 5,937,835 | A | 8/1999 | Turner et al. | |
| 6,070,852 | A | 6/2000 | McDonnell et al. | |
| 6,102,016 | A | 8/2000 | Sitar et al. | |
| 6,135,415 | A | 10/2000 | Kloda et al. | |
| 6,382,195 | B1 | 5/2002 | Green et al. | |
| 6,435,169 | B1 | 8/2002 | Vogt | |
| 6,494,041 | B1 | 12/2002 | Lebold | |
| 6,522,038 | B2 | 2/2003 | Byram | |
| 6,593,732 | B2 | 7/2003 | Dammkohler et al. | |
| 6,695,282 | B2 | 2/2004 | Clemens et al. | |
| 6,753,629 | B2 * | 6/2004 | Doi et al. | 310/68 D |
| 6,756,780 | B2 | 6/2004 | Hagio et al. | |
| 6,854,443 | B2 | 2/2005 | Keefover et al. | |
| 6,935,320 | B2 | 8/2005 | Veinotte | |
| 6,952,642 | B1 * | 10/2005 | Cowen | 701/113 |
| 6,962,325 | B2 * | 11/2005 | Torii et al. | 251/305 |
| 7,017,550 | B2 | 3/2006 | Hata et al. | |
| 7,053,510 | B2 | 5/2006 | Doi | |
| RE39,257 | E | 9/2006 | Kamimura et al. | |
| 7,210,451 | B2 * | 5/2007 | Ikeda et al. | 123/399 |
| 2003/0178004 | A1 * | 9/2003 | Keefover et al. | 123/399 |
| 2004/0154589 | A1 * | 8/2004 | Wayama et al. | 123/399 |
| 2005/0103308 | A1 * | 5/2005 | Keefover et al. | 123/337 |
| 2005/0183695 | A1 * | 8/2005 | Keefover et al. | 123/399 |
| 2006/0070604 | A1 * | 4/2006 | Sasaki | 123/337 |
| 2006/0213484 | A1 * | 9/2006 | Schmidt et al. | 123/399 |

OTHER PUBLICATIONS

Written Opinion for Corresponding International Patent Application No. PCT/US2007/084449.

Non-Final Office Action mailed Mar. 25, 2009, U.S. Appl. No. 12/342,764, filed Dec. 23, 2008, Title: "Air Valve and Method of Use," First Named Inventor: Oswald Baasch.

"Linear / Angular / Rotary Displacement Sensors: HMC1501 / HMC1512," Honeywell Sensor Products, Aug. 2000, pp. 1-4, Honeywell Inc., United States of America.

* cited by examiner

AIR VALVE AND METHOD OF USE

CROSS REFERENCE TO RELATED APPLICATIONS

This application is a continuation-in-part of U.S. patent application Ser. No. 11/559,067, filed Nov. 13, 2006.

STATEMENT REGARDING FEDERALLY SPONSORED RESEARCH OR DEVELOPMENT

Not applicable.

REFERENCE TO APPENDIX

Not applicable.

FIELD OF THE INVENTION

This disclosure relates to control systems and more particularly to an electronic control system for engines.

BACKGROUND OF THE INVENTION

The prior art includes technology for spark ignition engine that achieved air management via electronic controls. Air flow management devices for engine applications have historically used brush type permanent magnet motors and pulse width modulation speed control. Brush type permanent magnet motors do not maintain a sufficient reliability because of a relatively short life expectancy. Therefore a need exists for the use of brushless motors.

Due to the low life expectancy of brush type DC motors, some original equipment (OE) companies have developed the throttle valve further to incorporate brushless direct current (BLDC) motor technology. BLDC motor technology is employed because of high vibration/load, high torque to package ratio, high speed, and angular accuracy. However, the primary application for such valves is to meter air flow of air induction systems on the inlet side of naturally or forced induction engine applications. Therefore, a need exists to use a robust brushless design for use in a variety of applications requiring a long lifespan.

In the prior art, high-level control is generally provided by the engine control unit (ECU). Commands from the ECU to the motor are determined by application-specific operating strategies based on multiple engine operating parameters including load and speed. An air valve shaft position sensor is required in these applications to provide feedback for the ECU.

The throttle position sensor has typically used a contact wiper in the prior art. This device is also subject to reliability issues because of a relatively short life expectancy. Therefore, a need exists for a contact-less sensor for improved reliability and accuracy.

Moreover, the prior art includes complex and cumbersome designs for air valves and sensors that are difficult to fit into applications because of size, weight, and other considerations. Therefore, a need exists for a compact, efficient packaged design that allows for use in a variety of applications.

BRIEF SUMMARY OF THE INVENTION

The present invention provides an air valve including an air valve housing; a throttle plate disposed on a throttle shaft; a driven gear attached on the throttle shaft; a brushless direct current motor assembly in connection via a pinion with the driven gear; an integrated electronic valve controller including digital signal processing on a circuit board; and a throttle position sensor on the circuit board, wherein the throttle position sensor comprises at least one non-contact type sensor. In a preferred embodiment, the air valve may include the following features: a torsion spring, wherein a gear reduction is achieved through a single stage gear set, wherein the air valve can manage fluids over about 125 psi absolute, wherein the driven gear is a helical gear, spring gear, bevel gear, or spiral gear, wherein the integrated electronic valve controller is capable of communicating with an engine control unit via PWM and CAN signals, wherein the air valve has a response time of less than about 125 ms for a full rotation of the throttle plate, wherein the air valve has a valve position resolution of less than about 1 angular degree, wherein the air valve comprises an inlet port and an outlet port connected to an engine via an air intake manifold, wherein the throttling function of the air valve generates a low pressure region in the downstream section of the induction system after the air valve capable of creating a flow of re-circulated exhaust gas into the air intake manifold, wherein a position of the throttle plate is established by an onboard controller based on a command signal received from a vehicle engine control unit, wherein signals from the engine control unit are pulse width modulation or controller area network protocol, and/or wherein the air valve is a butterfly style air valve.

The present invention also provides for a method of using an air valve which includes the steps of sensing a position of a throttle plate disposed on a throttle shaft connected to driven gear within an air valve housing in the air valve by using a throttle position sensor on a circuit board, wherein the throttle position sensor comprises at least one non-contact sensor, actuating a brushless direct current motor assembly in connection with the driven gear; and rotating the throttle plate. The present invention may also include biasing the throttle plate in an open position with a torsion spring, wherein the air valve comprises an inlet port and an outlet port connected to an engine via an air intake manifold, such that re-circulated exhaust gas can be introduced into the air intake manifold, positioning the throttle plate by using an onboard controller based on a command signal received from a vehicle engine control unit, and/or using an integrated electronic valve controller including digital signal processing in the BLDC controller.

The present invention is an air valve developed for use in single stage or compound forced-induction engines located in the high pressure side of the induction system. The actuator of this air valve is a brushless type direct current servo motor. The air valve design includes high pressure shaft seals able to withstand high pressures encountered in single stage or compound supercharged engines. Primary applications for the device are heavy-duty compression ignition engines but the device also has the potential applications in new engine technologies such as throttle-less spark ignition engines or homogenous charge compression ignition engines.

The air valve is designed to restrict air flow in the high pressure section of the inlet system after inlet pressure has been raised by a single stage or multiple forced-induction devises. The low pressure region generated downstream from the valve induces a flow of re-circulated exhaust gas (EGR) into the air intake manifold. Metering of the EGR is achieved by varying the throttling degree of the air valve which controls the downstream pressure. Position of the valve is established by the onboard controller based on a command signal received from the vehicle ECU. This command signal maybe of the PWM or CAN type. The valve controller measures throttle position via a non-contact position sensor. Position feedback can be sent to the engine ECU via PWM or CAN. Valve position feedback and valve fault signals can be sent via PWM channel by assigning specific bandwidths to each function. In the event a specific valve malfunction occurs, a fault code is provided to the ECU via PWM or CAN.

During normal operation the valve is driven in both directions (clockwise and counterclockwise) by the motor and does not rely on the torsion spring. During engine shut down or in the event of valve malfunction the torsion spring drives the throttle to a fully open position. This provides a benign failure mode for diesel engine air management applications.

In a preferred embodiment, the BLDC motor may achieve response time of less than about 125 ms from fully open to fully closed, withstand vibration signatures of about 18 g RMS and temperature extremes from about −40° C. to about 150° C., deliver a life expectancy of about 20,000 hrs of operation, be compatible with air valves with bore sizes ranging from about 40 to about 150 mm, and/or operate on both 12 and 24V electrical systems.

Figure 1:
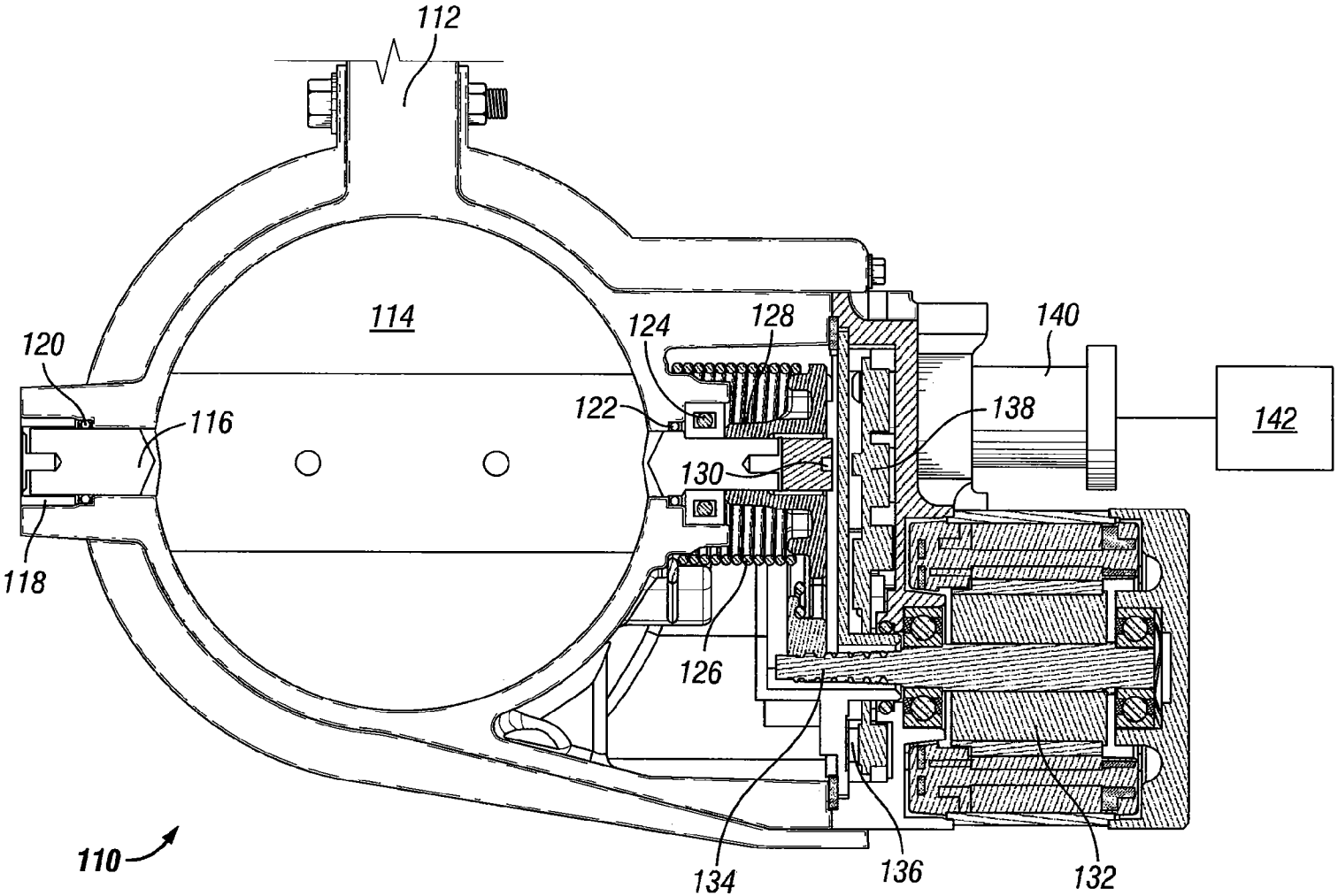
FIG. 1 illustrates a top cross section of the preferred embodiment.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

One or more illustrative embodiments incorporating the invention disclosed herein are presented below. Not all features of an actual implementation are described or shown in this application for the sake of clarity. It is understood that in the development of an actual embodiment incorporating the present invention, numerous implementation-specific decisions must be made to achieve the developer's goals, such as compliance with system-related, business-related, government-related and other constraints, which vary by implementation and from time to time. While a developer's efforts might be complex and time-consuming, such efforts would be, nevertheless, a routine undertaking for those of ordinary skill in the art having benefit of this disclosure.

The present invention is designed to provide enhanced engine exhaust emission management. In a preferred embodiment, the air valve features a package optimized aluminum body with a single electric connection. The air valve can be used in conventional engine technologies such as air management for internal combustion (IC) and diesel (DI) engines and advanced engine technologies such as air management of hybrid, gasoline direct ignition (GDI) engine applications as well as cold or hot EGR management and exhaust flow applications or forced-induction wastegate management. In a preferred embodiment, the valve can manage fluids up from about 0 to about 125 psi absolute (about 0 to about 860 kPa absolute) and would be at least available in bore sizes from 55, 65, 75, 85, 100 mm and be available for both 12V and 24V engine electrical systems.

The air valves feature BLDC motor technology with single stage gear train and a throttle position sensor based on non-contact sensor technology. High strength alloys and advanced machining processes are used in manufacturing of the gear train to assure accurate valve position, low NVH, maximum durability and efficiency.

Referring to FIG. 1, the air valve 110 may be used to meter EGR in engine applications with single or compound forced-induction devices. As shown, the air valve 110 includes an air valve housing 112, in which a throttle plate 114 is disposed on the throttle shaft 116.

The throttle shaft 116 is supported radially by needle bearing 118 and ball bearing 124. Axial translation is restricted by ball bearing 124.

The throttle shaft 116 passes through shaft seals 120 and 122. The sealed shaft 116 is capable of handling flow management from about 0 to about 125 psi absolute (about 0 to about 860 kPa absolute) and avoiding pressurized condensate penetration, but it is preferable for the seals 120 and 122 to be capable of handling flow management over about 125 psi absolute (860 kPa absolute). The throttle shaft 116 also rests on ball bearings 124, which preferably include dual lip sealed bearings for improved durability, reliability, and position accuracy.

A torsion spring 126 translates its torsional force to the throttle shaft 116 via the driven gear 128. Unlike the prior art, the torsion spring 126 of the present invention is not the primary method of closing the valve 110. In a preferred embodiment, the torsion spring 126 is capable of biasing the throttle plate 114 in an open position. The shaft position magnet 130 is pressed into the driven gear 128, wherein the driven gear 128 is connected or otherwise attached to the throttle shaft 116.

The shaft of BLDC motor assembly 132 contains a helical pinion 134 that passes through the gear cover 136 and printed circuit board 138. The BLDC motor helical pinion 134 interacts with the driven gear 128. The driven gear 128 may preferably be helical sector gear, a spring gear, a bevel gear, or spiral bevel gear. The gear reduction is achieved in a single stage format.

The printed circuit board 138 is located within the BLDC motor housing 112 to minimize electrical losses and EMI from exterior sources and contains the shaft position sensors in the vicinity of the shaft position magnet 130 thus generating a highly dense actuator design package. The rotation of shaft 116 is detected by the sensor on printed circuit board 138 due to change in orientation of the magnetic field generated by the shaft position magnet 130. This compact BLDC motor assembly 132 allows for a universal very compact package that can be used in a variety of valve type applications with restricted real estate. The communications between the air valve controller contained in the printed circuit board 138 and the engine ECU is handled through PWM signals or CAN protocol (according to J1939). The PWM command/feedback signal is transferred at a base frequency of 229 Hz, although the firmware can adapt to any frequency multiple of 229 Hz, i.e. 1*229, 2*229, 0.5*229, etc. The amplitude of the command/feedback signal are 0-12V and 0-5V respectively although the signal can be trimmed to any signal amplitude to accommodate to the communication requirements of the application. The preferred embodiment includes six fault code signal options that can be transmitted via PWM or CAN communication option according to SAE J1939.

A female electric connector 140 is shown in connection with the air valve housing 112 near the BLDC motor assembly 132. The present invention may include four pin (PWM only) or six pin (PWM and CAN) or (PWM and RS232)

sealed electric connector 140, although any multi-pin electric connector type is feasible to accommodate specific actuator-ECU communications required by the application. The RS232 connections can be used for password or encryption protected diagnostics and/or program upgrades. The connector 140 is preferably connected remotely to the ECU 142 via a wire harness with a male connector.

The actuator of the air valve 110 is a brushless type direct current servo motor shown as the BLDC motor assembly 132. The air valve design includes high pressure shaft seals 120 and 122 able to withstand high pressures encountered in forced-induction engines including compound supercharged engines. Primary applications for the device are exhaust emission management of forced induced heavy-duty compression ignition engines but the device also has the potential applications in new engine technologies such as throttle-less spark ignition engines or homogenous charge compression ignition engines.

It is preferable for the valve to have a response time of below about 125 ms for a 90° rotation. The valve may have a valve position resolution of less than about 1 angular degree, with a repeatability of less than about 1 angular degree, with a valve position relative to command position of about ±0.5 angular degree.

The microprocessor on the circuit board 138 adjust the operational speed of the valve according to the ambient temperature and supply voltage. The response time of the motor is held constant by trimming the current and duty cycle of the motor.

Referring to FIG. 1, during normal operation the valve is driven in both directions (clockwise and counterclockwise) by the motor assembly 132 and does not rely on the torsion spring 126. During engine shut down or in the event of valve malfunction the torsion spring 126 drives the throttle plate 114 to a fully open position. This provides a benign failure mode for diesel engine air management applications.

In a preferred embodiment, the BLDC motor 132 may achieve response time of about 125 ms from fully open to fully closed, withstand vibration signatures of about 18 g RMS and temperature extremes from about −40° C. to about 150° C., deliver a life expectancy of about 20,000 hrs of operation, be compatible with air valves with bore sizes ranging from about 40 to about 150 mm, and/or operate on both 12 and 24V electrical systems.

The preferred embodiment includes a butterfly style air valve. The preferred embodiment utilizes a torsion spring biased to an open condition. It is preferable for driven gear to be a single stage helical gear for packaging, robustness, reliability and reduced noise.

Moreover, the BLDC motor assembly and gearing arrangement preferably are formed such that the preferred embodiment includes an integrated motor/controller/gearbox capable of accommodating a variety of internal flow passage diameter, including but not limited to about 45 to about 150 mm inner diameter and various inlet/outlet arrangements including straight-through, angled or complex arrangements. It is also preferable for the shaft seal 120 to be able to accommodate running at high fluid pressures up to about 125 psia (about 860 kPa absolute).

With respect to the electronics of the air valve, it is envisioned that the use of an integrated electronic valve controller including advanced analog and Digital Signal Processing (DSP) in the BLDC controller and sensor printed circuit board 138 is preferable, along with the use of a non-contact shaft position sensor and efficient motor drive circuit. Robust system is factory-programmed with firmware to communicate with specific customer ECU.

The BLDC motor assembly 132 preferably includes an integrated brushless BLDC servo motor and gearbox package for high torque, high speed and accuracy. It is envisioned that this assembly is PWM and CAN I/O protocol compatible, fully operational at about −40° C. to about 125° C., and 12V and 24V compatible. It is envisioned that during normal use of the present invention, the B10 life expectancy is about 20,000 hours.

Figure 2:
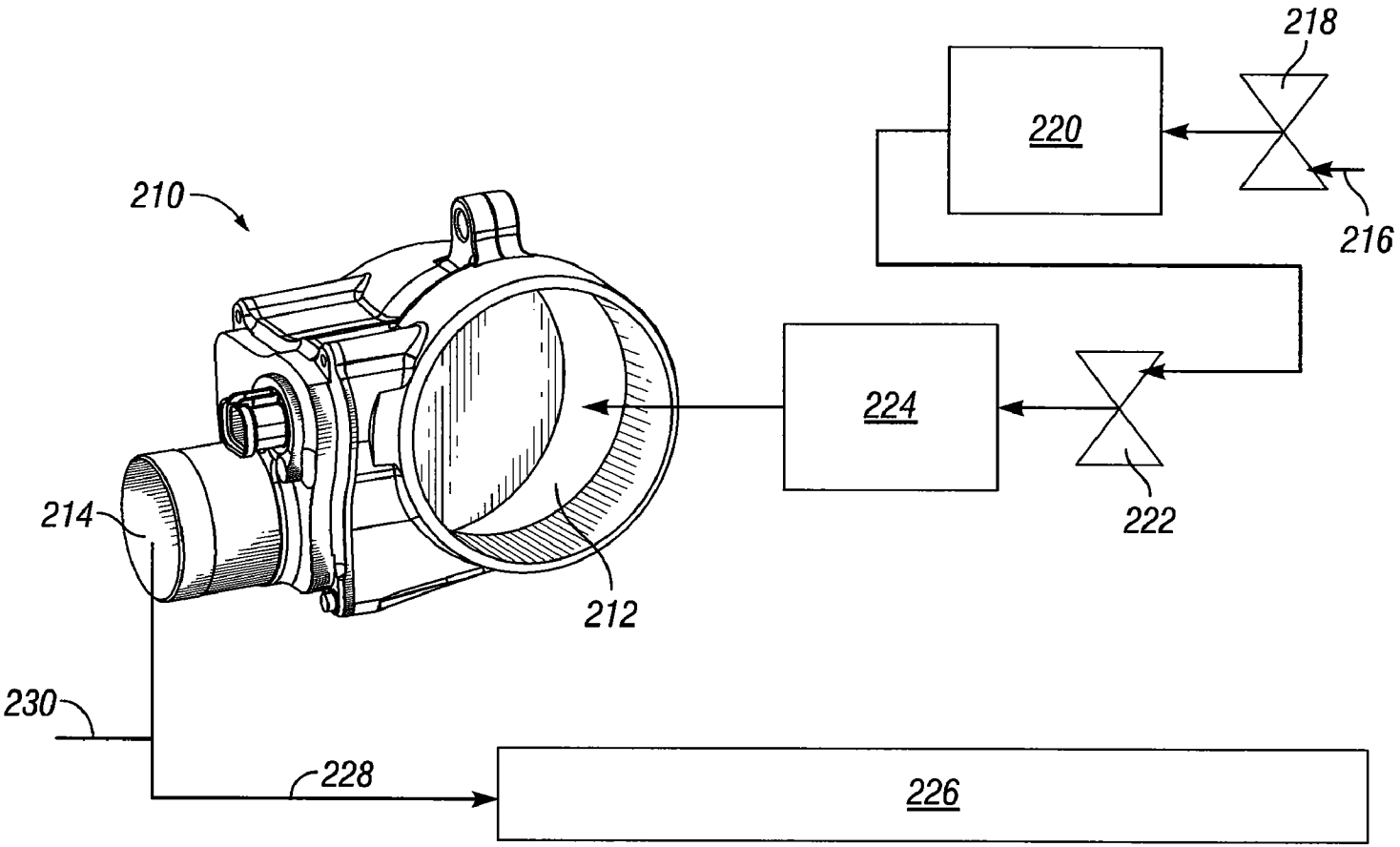
FIG. 2 shows a flow diagram of the preferred embodiment.

Referring to FIG. 2, the air valve 210 is shown in a preferred arrangement. In this embodiment, the air valve 210 has an inlet port 212 and an outlet port 214 shown. In use, air enters an air inlet 216 of a low pressure turbo charger 218. After passing through the low pressure turbo charger 218, the air passes through a low pressure air charger cooler 220. The air exits the low pressure air charger cooler 220 and enters a high pressure turbo charger 222. The air exits the high pressure turbo charger 222 and enters a high pressure air charge cooler 224. The air from the high pressure air charge cooler 224 and enters the inlet port 212 of the air valve 210.

The induced air is routed from the outlet port 214 to the engine 226 via an air intake manifold 228. In the arrangement shown in FIG. 2, a flow of re-circulated exhaust gas (EGR) 230 enters the air intake manifold 228 between the outlet port 214 and the engine 226. EGR is induced into the air intake manifold 228 due to the low pressure region generated by the throttling effect of the air valve 210 upstream of the air intake manifold 228. The flow rate of the induced EGR is directly proportional to the differential pressure generated between the inlet port 212 and the outlet port 214 of the air valve 210 when the air valves chokes the air flow according to the commanded position of throttle plate by ECU.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intends to protect all such modifications and improvements to the full extent that such falls within the scope or range of equivalent of the following claims.

What is claimed is:

1. An air valve comprising:

an air valve housing;

a throttle plate disposed on a throttle shaft;

a driven gear attached on the throttle shaft;

a shaft position magnet positioned on the driven gear;

a brushless direct current motor assembly disposed within a motor housing and in connection via a pinion with the driven gear;

a circuit board disposed within said motor housing and directly connected to the brushless direct current motor comprising:

an integrated electronic valve controller including digital signal processing on a circuit board; and a non-contact type throttle position sensor on the circuit board, wherein the non-contact type throttle position sensor detects a rotation of the throttle shaft due to a change in orientation of a magnetic field generated by the shaft position magnet; and a RS232 connector.

2. The air valve of claim 1 further comprising a torsion spring acting on the throttle shaft.

3. The air valve of claim 1 wherein a gear reduction is achieved through a single stage gear set.

4. The air valve of claim 1 wherein the air valve can manage fluids over about 125 psi absolute.

5. The air valve of claim 1 wherein the driven gear is a helical gear, spring gear, bevel gear or spiral gear.

6. The air valve of claim 1 wherein the integrated electronic valve controller is capable of communicating with an engine control unit via pulse width modulation (PWM) and controller area network (CAN) signals.

7. The air valve of claim 1 wherein the air valve has a response time of less than about 125 ms for a rotation of the throttle plate between an open position and a closed position.

8. The air valve of claim 1 wherein the air valve has a valve position resolution of less than about 1 angular degree.

9. The air valve of claim 1 wherein the air valve further comprises:

an inlet port;

an outlet port connected to an engine by an air intake manifold; and a source of re-circulated exhaust gas;

wherein the source is connected to the air intake manifold.

10. The air valve of claim 1 wherein a position of the throttle plate is established by an onboard controller based on a command signal received from a vehicle engine control unit.

11. The air valve of claim 1 wherein signals from the engine control unit are pulse width modulation or controller area network protocol.

12. The air valve of claim 1 wherein the air valve is a butterfly style air valve.

13. An air valve comprising:

an air valve housing;

a throttle plate disposed on a throttle shaft;

a driven gear coupled with the throttle shaft;

a shaft position magnet disposed on the driven gear;

a brushless direct current motor assembly disposed within a motor housing and in connection via a pinion with the driven gear;

a torsion spring;

a circuit board disposed with said motor housing and directly connected to the brushless direct current motor comprising;

an integrated electronic valve controller that performs digital signal processing; and a non-contact type throttle position sensor on the circuit board, wherein the non-contact type throttle position sensor detects a rotation of the throttle shaft due to a change in orientation of a magnetic field generated by the shaft position magnet; and a RS232 connector.

14. The air valve of claim 13 wherein the driven gear is a helical gear, spring gear, bevel gear, or spiral gear.

15. The air valve of claim 13 wherein the air valve comprises an inlet port and an outlet port connected to an engine via an air intake manifold, wherein a source of re-circulated exhaust gas is connected to the air intake manifold.

16. The air valve of claim 1, wherein the circuit board is a single-plane circuit board having one or more layers.

17. The air valve of claim 13, wherein the circuit board is a single-plane circuit board having one or more layers.

* * * * *